US005257513A

United States Patent [19]

Leach, II

[11] Patent Number: 5,257,513

[45] Date of Patent: Nov. 2, 1993

[54] BALL EARRING PROCESS AND CONSTRUCTION

[75] Inventor: Edwin F. Leach, II, Attleboro, Mass.

[73] Assignee: Leach & Garner Company, North Attleboro, Mass.

[21] Appl. No.: 912,156

[22] Filed: Jul. 10, 1992

[51] Int. Cl.[5] ..... A44C 7/00

[52] U.S. Cl. ..... 63/12; 29/160.6

[58] Field of Search ..... 63/12, 14.1; 428/577, 428/580; 29/160.6

[56] References Cited

U.S. PATENT DOCUMENTS

| | | | |
|---|---|---|---|
| 3,504,507 | 4/1970 | Ferro | 63/12 |
| 4,307,582 | 12/1981 | Mancini | 63/12 |
| 4,383,002 | 5/1983 | Manolescu | 63/12 |
| 4,459,829 | 7/1984 | Richard | 63/12 |
| 4,510,772 | 4/1985 | Alley | 63/12 |
| 4,943,274 | 7/1990 | Edwards | 63/12 |

FOREIGN PATENT DOCUMENTS

| | | | |
|---|---|---|---|
| 651702 | 3/1928 | France | 63/12 |

*Primary Examiner*—Peter M. Cuomo
*Assistant Examiner*—Flemming Saether
*Attorney, Agent, or Firm*—Sommer, Oliverio & Sommer

[57] ABSTRACT

A process for manufacturing a jewelry piece such as a ball earring pin which includes a predetermined length of the solder-filled wire that serves as both an earring wire post and domed cup for seating and attachment of an ornament, namely, the ball of a ball earring. At one end of the wire, the wire casing is flared back and separated from the core thereby exposing a nib of solder. The wire casing which is separated from the core is formed into the shape of a domed cup complimenting with the curvature of the ball. The nib which extends into a hole in the ball is then heated to melt the solder such that the ball is secure within the cup after the solder cools.

4 Claims, 5 Drawing Sheets

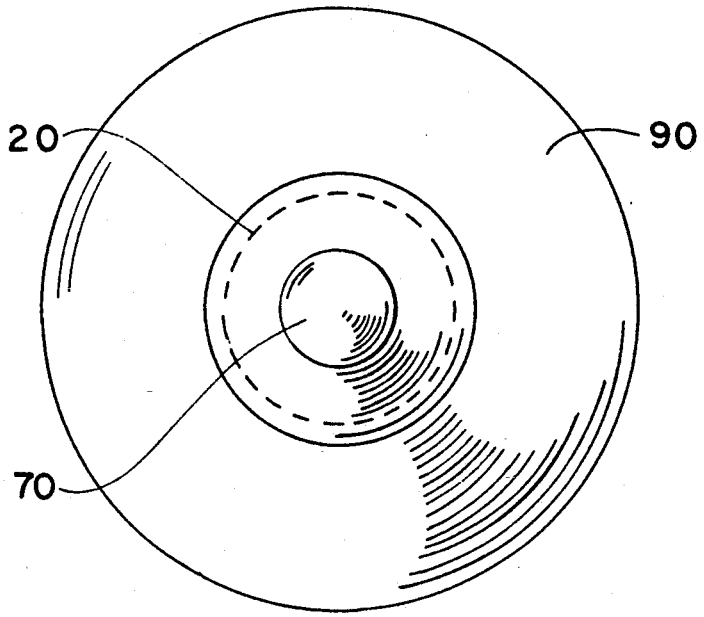
FIG. 2
FIG. 3
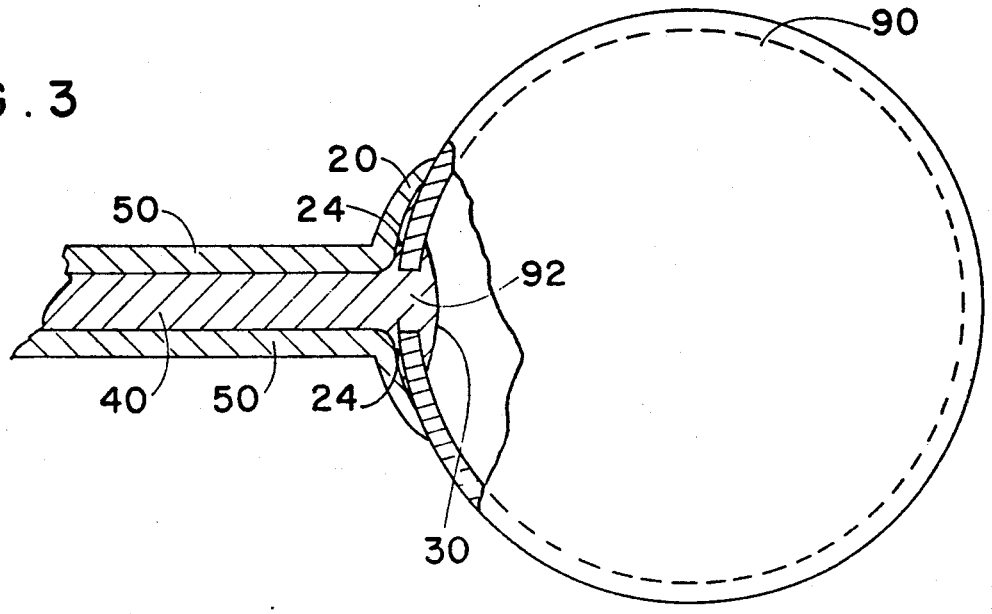

BALL EARRING PROCESS AND CONSTRUCTION

FIELD AND BACKGROUND OF THE INVENTION

The present invention relates to a new and useful process and construction for a ball earring.

It is common in the jewelry field to solder an ear wire consisting of a cylindrical rod or pin to a domed cup prior to soldering the wire and cup combination to the ball to form a ball earring.

The process involves stamping a dome shaped circular blank from a sheet of metal such as gold. This step is known as a pad blanking. A circular hole is then made within the blank for receiving an ear wire in the form of a cylindrical rod or pin. The pin is inserted into the hole in a staking operation and with a solder flushed surface on the dome opposite the side from which the pin is inserted. The dome is clad with solder. The combined pin and domed cup is then soldered to an ornament, which in the case of a ball earring, is a hollow ball.

This conventional process requires several major and distinct steps before attachment of an ornament. First, the construction of the domed cup involves cutting and shaping the cup, then piercing the cup. Second, the post is cut to length and then machined to form a bullet-shaped end and nut-engaging groove near the end. Third, the attachment of the post to the cup is completed. Finally, a step of soldering the assembly of the cup and post to the ball is completed.

SUMMARY OF THE INVENTION

The present invention is a new and useful process and construction for jewelry piece manufacturing, particularly, in the construction of a ball earring.

The present invention comprises the use of a solder-filled wire casing, formed to a pre-determined length, in order to serve as both a post and cup-shaped head for a ball earring.

One end of the wire serves as a head for receiving the ball. The head is constructed by forming a portion of the casing of the solder-filled wire at one end of the length of the wire into the form of a domed cup. The resulting domed cup extends around an exposed nib of solder which protrudes from the head. The purpose of the exposed nib is to secure the ball to the pad in the correct position with the hole held within the cup and to provide the solder needed to bond the ball to the cup.

In accordance with the invention, therefore, a process is provided for manufacturing a jewelry piece such as a ball earring which includes a pin that includes a predetermined length of the solder-filled wire that serves as both an earring wire post and domed cup for seating and attachment of an ornament, namely, the ball of a ball earring. At one end of the wire, the wire casing is flared back and separated from the core thereby exposing a nib of solder. The wire casing is formed into the shape of a domed cup with the curvature of the ball. The nib which extends into a hole in the ball is then heated to melt the solder such that the ball is secure within the cup after the solder cools.

It is an object of the present invention to provide a jewelry piece construction process which eliminates using a separate blank in order to manufacture a cup-shaped crown.

Another object of the present invention is to provide an earring post and cup that is of one piece design.

A further object of the present invention is to provide a jewelry piece having a cup-shaped head that can be securely fastened to an ornament.

Another object of the present invention is to decrease manufacturing steps in the process for constructing a jewelry piece.

It is another object of the present invention to provide an efficient manufacturing process that conserves on the use of precious resources such as electricity and precious raw materials such as gold.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 2 is an inner end view of the post with ball attached;

FIG. 3 is a partial side sectional view of the post with the ball attached;

DESCRIPTION OF THE PREFERRED EMBODIMENTS

Figure 1:
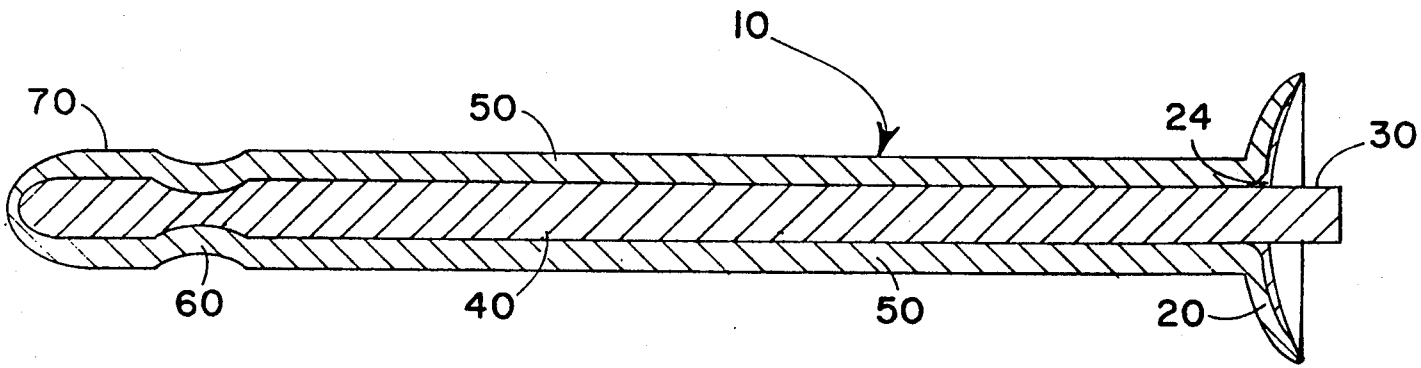
FIG. 1 is a cross-sectional view of a wire post for an earring after the heading step.

Referring to the drawings in particular, FIG. 1 shows an earring wire in the form of a cylindrical rod or post, generally designated 10, before an ornament is attached. The post 10 is a length of a solder-filled wire composed of a solder core 40 encased by a wire casing 50. The wire casing 50 is typically a precious metal such as gold.

After a length of solder-filled wire has been chosen for the post 10, a head, in the form of a domed cup 20 is formed from the post 10 by separating part of the casing 50 from the core 40. The domed cup 20 can be formed by completely separating the casing 50 from the core 40, thereby forming a nib 30 of exposed solder. The domed cup 20 has a contour which compliments curvature of a ball or bead 90 as shown in FIG. 3.

As shown in FIG. 1, a solder layer 24 may also be separated from the core 40 by paring back the layer 24 from the core 40 along with the casing 50 to provide a solder layer on inner surface of the cup 20.

By heating the nib 30 and the layer 24, ball 90 is easily soldered and secured to the post 10. The nib is first inserted into a hole 92 of the ornament 90 until it contacts the solder layer 24 in the head 20. The layer 24 provides additional support once attached to the ornament 90 after the solder cools.

A rolling step is also undertaken to form a back end 70 opposite the head 20 which is rounded or bullet-shaped for receiving an ear nut or other type of fastening and a groove 60 circumferentially around the back end 70, is used to fictionally secure the ear nut to post 10. Alternatively, a screw threaded post and ear nut could be used.

Figure 4:
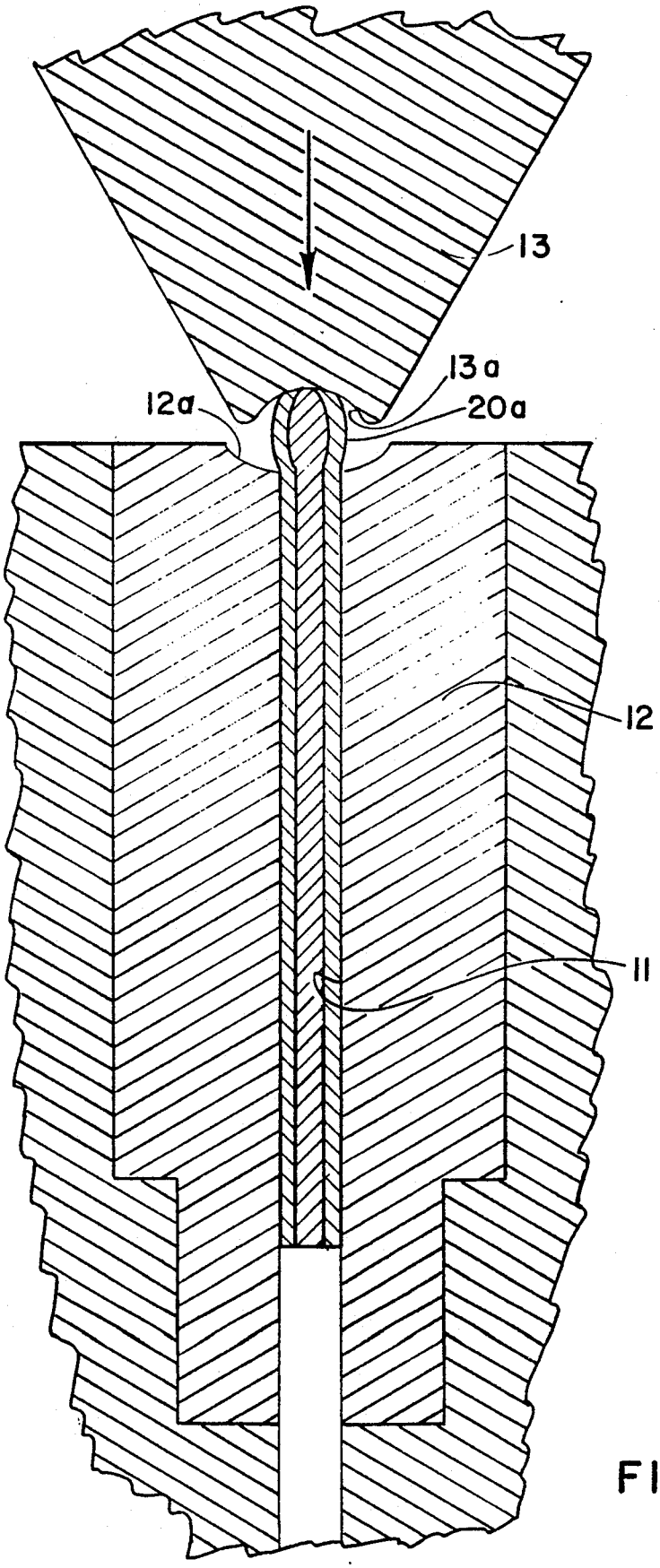
FIG. 4 is a partial sectional view of a receiving die and first punch for executing a first step in forming the post of the invention.
Figure 5:
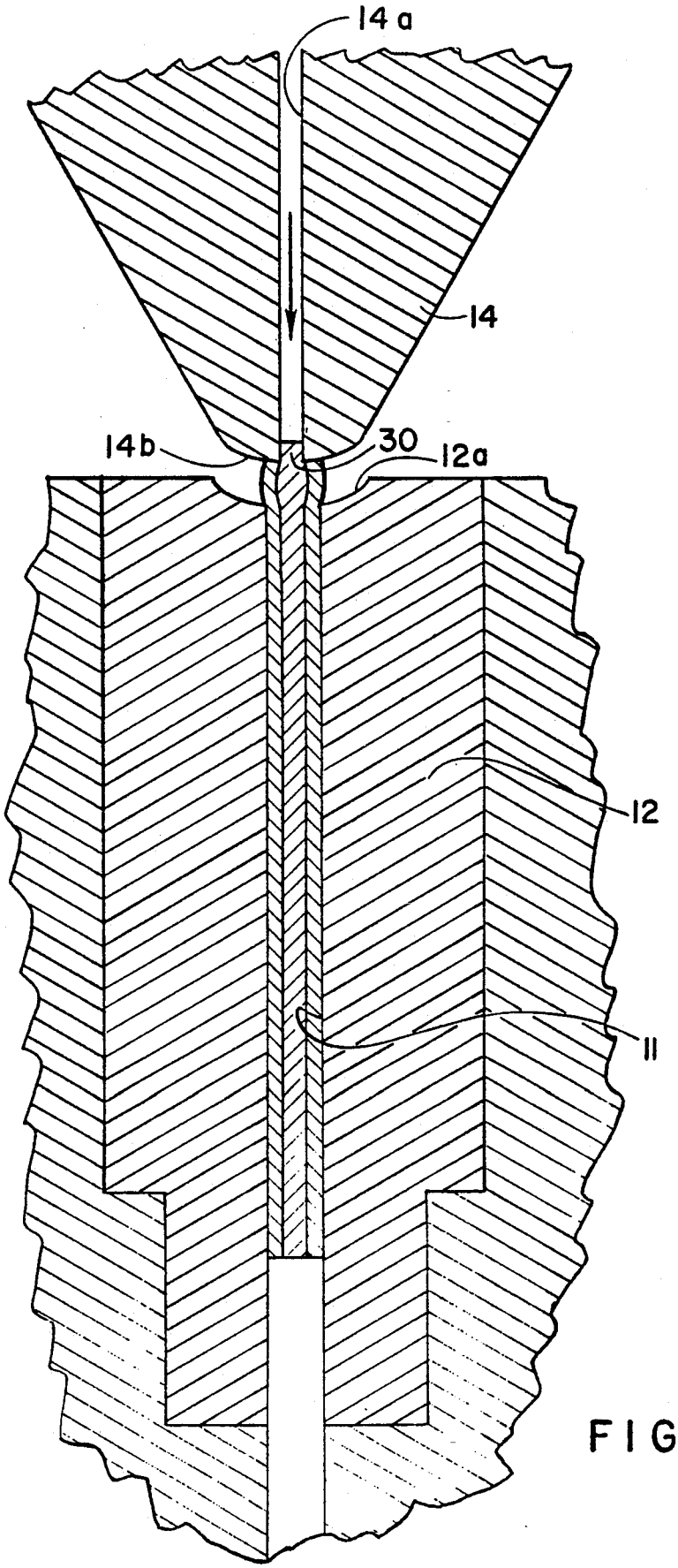
FIG. 5 is a view similar to FIG. 1 showing a second tool and final process step in making the post according to the present invention.

The tools used to form the head with or without the layer of solder 24 are a press and a die which are shaped in a manner shown in FIGS. 4 and 5. Rolling tools and apparatus for rolling the back end 70 of the pin into its rounded, pointed or bullet shape, and for rolling the circumferential groove 60 are also used. The rolling steps for making the bullet shaped back end 70 and circumferential groove 60 are of known design and save material over the prior machining steps used to form these shapes.

Turning to FIG. 4, in order to form head 20, the precut but otherwise unshaped wire is placed into a blind bore 11 of a receiving die 12 so that about 90 percent of its length is in the bore. Die 12 has a dish-shaped recess 12*a* around the inlet of bore 11. A first punch 13 is then moved in the direction of the arrow to upset and shape a portion of outer metal and a small amount of solder to form a pre-formed enlarged head 20*a*. Punch 13 has a concave face 13*a* that is shaped to form the head 20*a*.

As shown in FIG. 5, with the post still retained within the bore 11 of the receiving die 12, a second punch 14 which is moved in the direction of the arrow and has an outer shape matching the final shape of the undersurface of the cup 20 is moved into engagement with the pre-form 20*a* to form the final cup 20 with its solder coating 24 and the nib 30. The punch 14 has a second bore 14*a* that receives solder to form nib 30, and a convex face 14*b* which forms the cup 20 between punch 14 and dish-shaped recess 12*a*.

Figure 6:
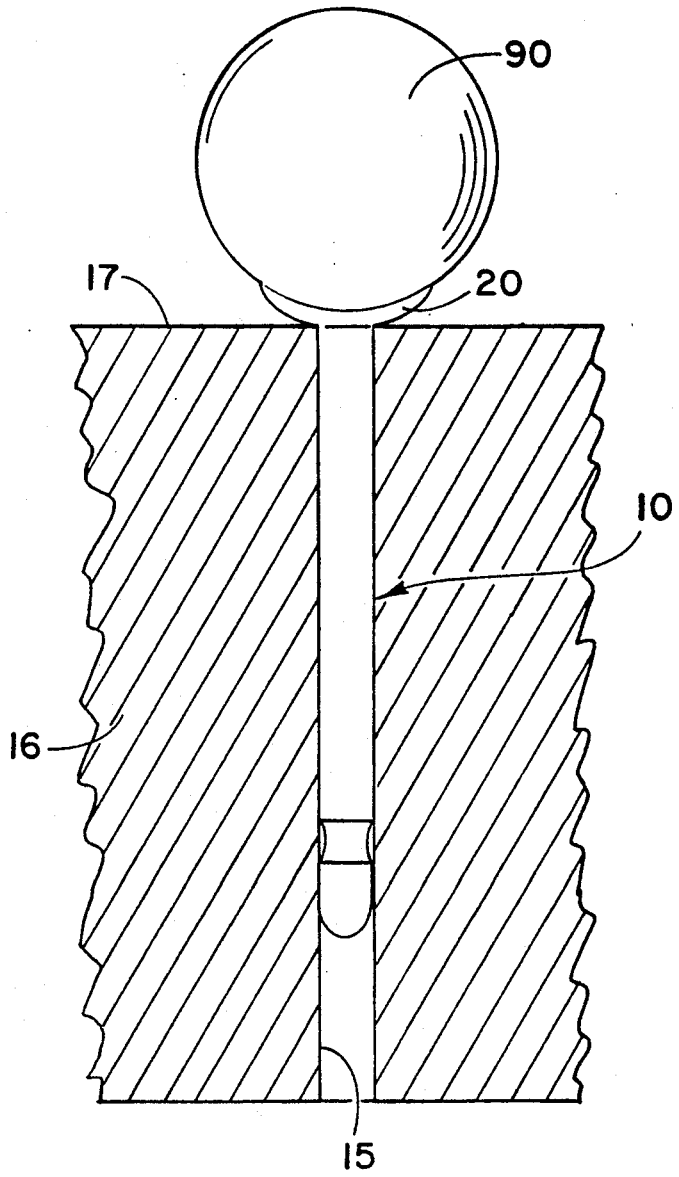
FIG. 6 is a partial sectional view of an apparatus for supporting the post plus ball during a final soldering step according to the present invention.

FIG. 6 illustrates a carbon block 16 having a plurality of bores, one of which is shown at 15, each for receiving a post 10 with its cup 20 resting on the top surface 17 of the block. The block is slowly moved through a furnace heated for example to 1,480° F. which melts the solder and thus fixes the bead 90 to the cup to produce the finished product shown in FIG. 3.

The present invention thus has the advantages of reducing waste since separate cup blanks need not be formed from strips of metal as in the previous technique. The separate step of connecting the post to the separate cup is also eliminated. The forming of the bullet shaped end 70 in groove 60 also represents a departure from the prior art which cuts the annular groove and machines the tapered bullet end of the pin. This also represents a savings in material and avoids granular waste which is a by-product of the prior machining and cutting steps. The present invention thus saves raw materials, in particular gold, with obvious benefit. The present invention also utilizes less electricity to form the same product and results in a one piece post which does not permit the cup to move with respect to the pin, which sometimes happens in the previous two part post.

Any conventional solder known in the field of jewelry manufacture can be utilized as solder 40 within the cylindrical length of wire or pin 50. Further, although the nib 30 is shown flared out over the wall thickness of the hollow ball or bead 90 in FIG. 3, the nib, when melted and then resolidified during the soldering operation may occupy an enlarged opening or other suitably shaped recess in the ornament to help fix the ornament to the pin.

While the specific embodiments of the invention have been shown and described in detail to illustrate the application of the principles of the invention, it will be understood that the invention may be embodied otherwise without departing from such principles.

What is claimed is:

1. A ball earring comprising:

a post having an outer casing and a solder core therein, the post having a back end and an opposite separated end, the core completely filing the casing between the back and the separated ends and separated end serving as a head and being shaped for direct attachment to a ball, the separated end being made as one piece with the casing; and a nib of solder protruding from and beyond the separated end for securing the ball to the separated end wherein the separated end is in the form of a domed cup for receiving the curvature of the ball.

2. A ball earring according to claim 1, including a circumferential groove around the post near the back end thereof.

3. A ball earring according to claim 2, including, in combination with the post, a ball soldered to the separated end by melting and resolidification of the nib.

4. A ball earring according to claim 3, including a layer of solder between the head and the ball.

* * * * *